United States Patent [19]

Rod

[11] 4,184,164

[45] Jan. 15, 1980

[54] DIRECTIVE LOOP ANTENNA

[75] Inventor: Robert L. Rod, Marina Del Rey, Calif.

[73] Assignee: Monogram Industries, Inc., Santa Monica, Calif.

[21] Appl. No.: 864,940

[22] Filed: Dec. 27, 1977

[51] Int. Cl.[2] ..... H01Q 7/00

[52] U.S. Cl. ..... 343/744

[58] Field of Search ..... 343/732, 741–744, 343/748, 802, 803

[56] References Cited

U.S. PATENT DOCUMENTS

| | | | |
|---|---|---|---|
| 2,166,750 | 7/1939 | Carter | 343/744 |
| 2,311,872 | 2/1943 | Rote | 343/744 |
| 3,078,462 | 2/1963 | Herman | 343/744 |
| 3,151,328 | 9/1964 | Boyer | 343/744 |
| 3,971,031 | 7/1976 | Burke | 343/744 |

FOREIGN PATENT DOCUMENTS

| | | | |
|---|---|---|---|
| 334655 | 3/1921 | Fed. Rep. of Germany | 343/744 |
| 978294 | 4/1951 | France | 343/741 |

OTHER PUBLICATIONS

A.R.R.L. Antenna Book; p. 66, 1960, American Radio Relay League.

*Primary Examiner*—Eli Lieberman
*Attorney, Agent, or Firm*—Freilich, Hornbaker, Wasserman, Rosen & Fernandez

[57] ABSTRACT

A square-loop directive antenna of half wavelength circumference is provided with improved front-to-back ratio and gain by placing capacitive reactances for 90° phase shift in the sides, instead of inductive reactances as in the past, and with further improved front-to-back ratio and gain by placing divided reactances (inductive or capacitive) in the sides with just enough reactance to provide a phase shift of 22.5° next to the driven side of the loop and the balance (90°–22.5°) next to the parasitic side of the loop.

4 Claims, 5 Drawing Figures

X INDUCTIVE)

DIRECTIVE LOOP ANTENNA

BACKGROUND OF THE INVENTION

This invention relates to a loop antenna, and more particularly to a square loop directive antenna.

A loop antenna is an antenna which provides an actual or virtual closed circuit through one or more turns of a conductor. In the case of a "large" loop, which is defined as one in which the current is not the same either in amplitude or phase in every part of the loop, the smallest length of conductor which can be used is ½ wavelength. The practice is to form the loop into a square ⅛ wavelength on each side, and to feed it at the center of one side. The current flows in the closed loop with maximum current at the center opposite the drive terminals, and minimum at the terminals. The result of such an antenna configuration and drive causes the field radiated to be maximum in the plane of the loop and in a direction from the drive terminals to the opposite side, unless the opposite side is opened at the center, in which case there is only a virtual closed circuit and the direction of maximum radiation is reversed. Such an open square loop antenna may be compared to a half-wavelength dipole antenna because it is in effect a dipole antenna that has been folded into a square loop with the ends of the dipole next to each other on the side of the loop opposite the drive terminals. However, unlike a half-wavelength dipole, there is no direction in which the radiation is zero. While maximum radiation is in the plane of the loop, there is appreciable radiation in the direction perpendicular to that plane, and there is also appreciable radiation to the "back," the direction opposite the "front" where the radiation is a maximum. The front-to-back ratio is of the order of about 5 db, and the front radiation is about 1 db less than that of a half-wavelength dipole in its optimum direction.

That ratio of front radiation to the back radiation of a square-loop antenna can be enhanced, and the gain can be increased to 1 db over a dipole antenna, by placing inductive reactances in the sides joining the front and back to the loop. This is because the inductive reactances decrease the current in the sides where they are included and increase it in the front. It has now been discovered that the same improvement can be achieved with capacitive reactance instead of inductive reactance, with only 180° change in the direction of maximum radiation.

SUMMARY OF THE INVENTION

An object of the present invention is to improve the directivity and gain of a square-loop antenna of half-wavelength circumference.

A further object is to cancel undesired radiation eminating from the sides of a square-loop antenna, thus obtaining essentially zero side radiation in a manner similar to a dipole at right angles to its desired radiation.

These and other objects of the invention are achieved by a square-loop antenna of half wavelength circumference driven at the center of one side, and having capacitive reactance for a 90° phase shift in the adjacent sides to achieve greater directivity and gain as one feature of the invention. As another feature, the reactance is inductive or capacitive, and is divided into two parts on each side, with the one part closest to the driven side of a value selected to obtain 22.5° phase shift in voltage with respect to antenna current, and the other part selected to obtain 67.5° phase shift, for a total phase shift of 90° across each side, thereby to increase directivity and gain and reduce radiation from the sides of the loop to substantially zero. Still another feature of the invention is to provide improved, low-loss capacitive reactances that are coaxial comprising a conductive tube and an inner insulated conductor. These are more efficient and weather-resistant than conventional inductive reactances.

The novel features that are considered characteristic of this invention are set forth with particularity in the appended claims. The invention will best be understood from the following description when read in connection with the accompanying drawings.

DESCRIPTION OF PREFERRED EMBODIMENTS

Figure 1:
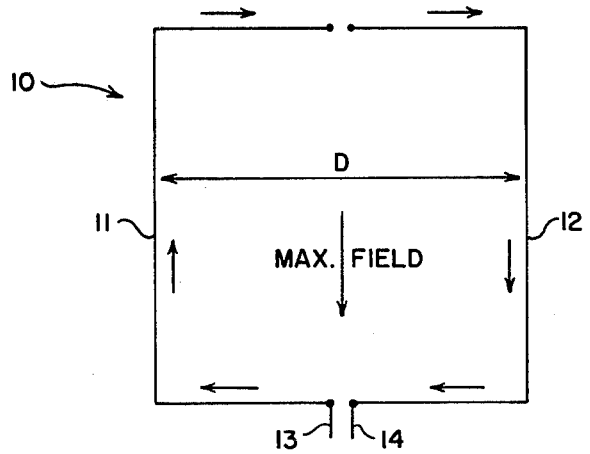
FIG. 1 (PRIOR ART)
FIG. 1 illustrates current and maximum field vectors for a square-loop antenna driven at the center of one side and open on an opposite side.

Referring now to FIG. 1, the usual configuration of the smallest practical conventional-type "large" loop antenna 10 is a square loop whose total conductor length is ½ wavelength. Each of the left and right sides is thus ⅛ wavelength, or 45° in terms of electrical length. Also, the distance, D, across the square is ⅛ wavelength or 45° electrical.

In the following discussion, performance of each loop antenna will be in terms of transmitting, it being understood that the case of receiving is just the reciprocal. The antenna is formed of two ¼ wavelength elements 11 and 12 driven through leads 13 and 14 at the center of one side shown at the bottom. The antenna is open circuit at the center of the opposite (top) side, but AC current nevertheless flows in the loop as shown by arrows as though it were a closed loop. One major difference between an open and a closed loop is that the direction of maximum radiation is opposite that indicated in FIG. 1 for the case of a closed loop. The other is the impedance change at the driven terminals. The FIG. 1 loop gives a low impedance at terminals 13,14 which is preferred. Consequently, although reference will be made here often to an open loop, the teachings of the present invention should be understood as applying to a closed square-loop antenna as well, with only those differences in the direction of maximum radiation and impedances.

Figure 2:
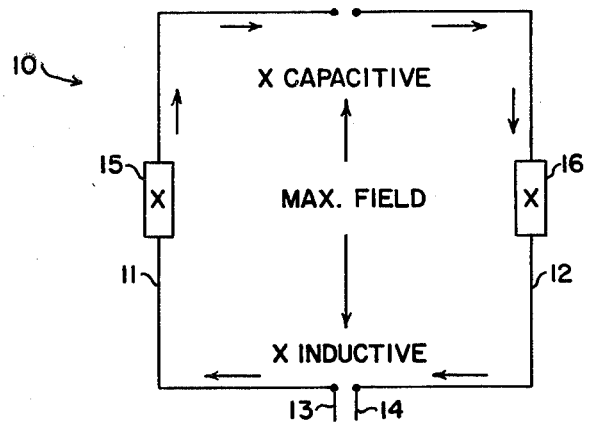
FIG. 2 (PRIOR ART
FIG. 2 illustrates the square-loop antenna of FIG. 1 with reactance on each side adjacent the driven side.

As noted hereinbefore, when an inductive reactance is placed in the left and right sides joining the front and the back of the loop, as is illustrated by inductances 15 and 16 in FIG. 2, the reactances decrease the current in the sides into which they are inserted and increase it in the front and back sides. It has been found that the same improvement can be achieved with capacitive reactances, but that the direction of maximum radiation changes 180° between the two as is indicated in FIG. 2 by an upward vector for capacitive reactance, as compared to the downward vector for no reactance (FIG. 1) or with inductive reactance.

The use of capacitors instead of inductors is advantageous as ohmic losses usually encountered with inductors are eliminated. Also, the problems of making such inductors secure against rain and corrosive elements in the atmosphere are easily solved by capacitors of various configurations, including those discussed hereinafter.

The magnitude of the reactance to be used is approximately 360 ohms when placed in the middle of the sides as shown in FIG. 2. With such a reactance placed at that point on each side, a phase shift of about 90° through each side is achieved, thus increasing the current in the front side. In that manner, radiation from the sides is reduced, and the maximum forward radiation is increased by about 1.0 db over a dipole. Front-to-back ratio for an antenna with single reactances in each side is in the order of 5 db.

Figure 3:
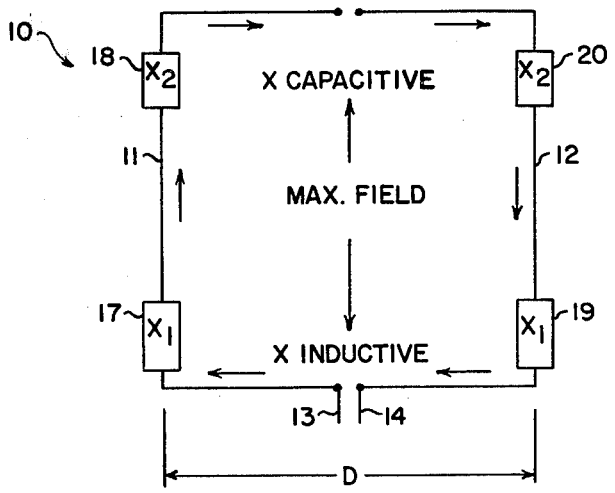
FIG. 3 illustrates the square-loop antenna of FIG. 2 with the reactance on each side divided into two parts.

Improved front-to-back ratio and 1 db added gain can be achieved by obtaining successive 22.5° and 67.5° phase shifts using separate reactances 17 and 18 ($X_1$ and $X_2$) on the left side, and reactances 19 and 20 ($X_1$ and $X_2$) on the right side as shown in FIG. 3. It has been found that the side radiation caused by opposing side currents can be negated in a square loop by so breaking up the side reactances X of FIG. 2 into two series reactances $X_1$ and $X_2$ on each side that the reactances closest to the drive point are of such value as to obtain a 22.5° phase shift in the voltage with respect to the current in each side. This phase shift is equal to the dimension D/2 or 22.5° also. This is illustrated in FIG. 3 where both reactances 17 and 19 are such as to yield the desired 22.5° phase shift, or something in close proximity to that. With the phase shift of reactances 17 and 19 fixed at 22.5°, it is necessary to provide the additional phase shift reactances 18 and 20 to equal 90° total per side in order to benefit from the increased gain afforded by using side reactances. Thus the reactances 18 and 20 are scaled to give a phase shift of 67.5°. Using these values, the unwanted side radiation from the two sides is effectively cancelled out, and front-to-back ratios exceeding 15 db have been achieved in actual field tests. That is a value comparable to the best 2-element full size Yagi-Uda array which is much larger, and therefore more cumbersome. At a frequency of 14 MHz, for example, an antenna of this configuration measures only 8 feet on a side compared to a 2-element Yagi having elements 32 feet long and spaced 10 feet apart. There is, of course, a price to pay for the smaller size of the square-loop antenna. Its gain is only about 1 db over a dipole compared to 5 db gain for the typical 2-element full-size Yagi-Uda array. Yet the directivities are almost the same for the two, an important consideration in telecommunications.

Figure 4:
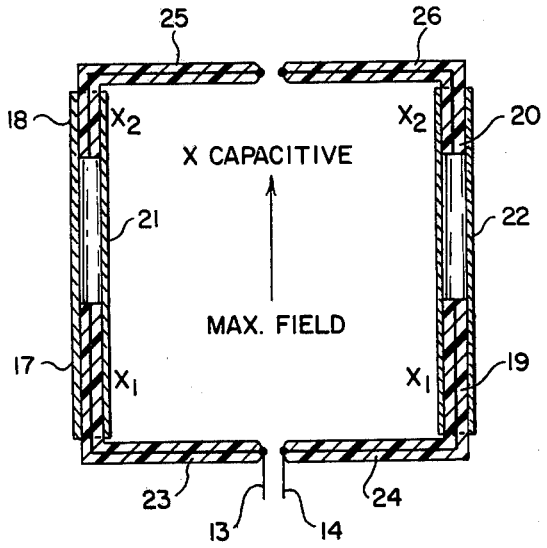
FIG. 4 illustrates schematically the manner in which the square-loop antenna of FIG. 3 is implemented with capacitive reactances on each side divided into two parts.

The use of capacitors for the reactances is preferred for the reasons noted hereinbefore, namely lower ohmic losses and the ease with which capacitors can be protected against rain and corrosive elements in the atmosphere. FIG. 4 illustrates how capacitors can be provided using a conductive tubes 21 and 22 for the sides of a square-loop antenna, conductive rods 23 and 24 for the driven (back) side and conductive rods 25 and 26 for the opposite (front) side. The capacitors are made up for each side by inserting a length of insulated conductive rod into the side tube. The value of capacitance achieved is set by the length and diameter of insulated capacitance thus inserted and the dielectric constant of the insulation selected. In actual practice, the inserted length of conductive rod will be excess length of insulated conductive rods 23 through 26 bent and cut at the appropriate points. The conductive rods may be, for example, pultrusions made from No. 14 copper conductor pulled through a heated die at the center of glass reinforced fibers that have been impregnated with a polyester resin. The reinforced polyester resin thermosets as a dielectric coating around the centered copper wire. If the outside diameter of the dielectric coating is selected to be equal to the inside diameter of the side tubes 21 and 22, the bent ends will fit firmly in the tubes.

Figure 5:
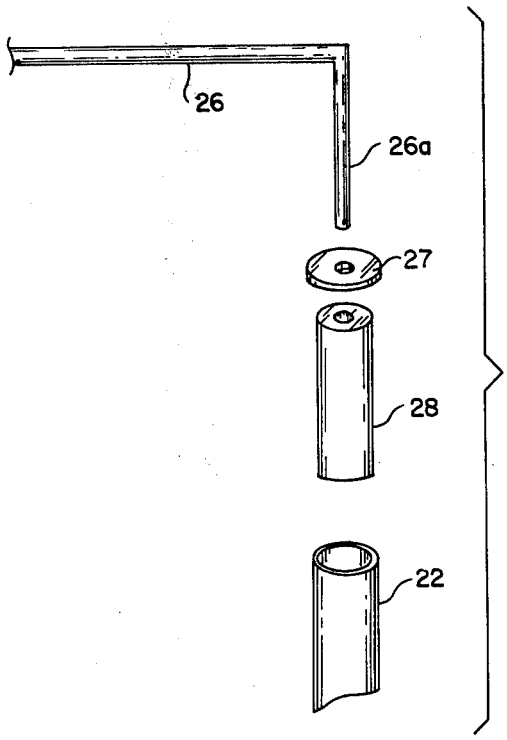
FIG. 5 illustrates in an exploded view an exemplary technique for implementing a capacitive reactance in the antenna of FIG. 4.

The elements of a capacitive reactance may be constructed in still another manner illustrated in FIG. 5 for the capacitive reactance 20. The end **26*a* of the conductive rod 26 is bent and cut. A large washer 27 of dielectric material is then slipped over the bent end 26*a*. Then a dielectric sleeve 28 is fitted on the bent end over the washer. The bent end thus insulated is then inserted into the side tube 22. The washer 27 serves to electrically isolate the end of the tube 22 from the rod 26** at the bend. However, if the rod is itself coated with insulating material, such a washer will not be required.

For a 14 MHz antenna, the $X_1$ capacitors are made in the manner illustrated in FIG. 4 by inserting a 4 foot bent end into one end of an 8 foot aluminum side tube. Typical capacitance per foot of such a capacitor is about 30 micromicrofarads, so 4 feet equals 120 micromicrofarads. The phase shift in a series circuit comprised of capacitance and series antenna resistance is determined by $$\tan(\text{phase shift angle}) = (X/R)$$

In a typical loop antenna, the desired 22.5 degree angle results from satisfying this equation. The same holds for the 67.5 degree phase shifter. As an example of the calculation performed for a 14 MHz antenna, assume the resistance of the antenna at the vicinity of the $X_1$ resistance is about 240 ohms at the point closer to the low 50 ohms driving impedance and away from the open end impedance of several thousand ohms. Under this assumption, the calculation for C is $$\tan(22.5°) = (X/R) = (X/240) = 0.414$$

$$X = 100 \text{ ohms}$$

$$C = 1/(2\pi \times f \times X) = 114 \text{ micromicrofarads}$$

where f is in Hz. The computed value 114 micromicrofarads is close to the actual 120 micromicrofarad capacitance of the 4 foot long section comprising reactance $X_1$. Conductors for the $X_2$ capacitive reactances are made 1 foot long and give the remaining 67.5 degrees of phase shift required. These capacitors could be replaced by other types of capacitors commercially available without changing the nature of the invention. As for the one feature of the invention achieved by dividing the reactance on each side into two parts, inductors could be substituted for capacitors with the only difference being a change in the direction of maximum radiation, as noted hereinbefore. Thus, what has been disclosed as one feature of the invention is a square-loop antenna with capacitive reactances in the sides to achieve all of the advantages of inductive reactances in the sides. It has the added advantages of less ohmic losses and ease in protecting the reactances against rain and other corrosive elements of the atmosphere, particularly when the reactance is formed by inserting an insulated conductor into a conductive tube on the side of the loop. By splitting the reactance on each side with part near the driven end for a phase shift of 22.5° and part near the other end for a phase shift of 67.5°, side radiation is cancelled with an effective 15 db value for front-to-back ratio equal to that of size 2-element Yagi antenna. For this second feature of the invention, the individual split reactances may be either inductive or capacitive, although it is preferable to use capacitive reactances to achieve both features of the invention.

Although particular embodiments of the invention have been described and illustrated herein, it is recognized that modifications and variations may readily occur to those skilled in the art. For example, if the loop antenna is rectangular but not square, i.e., all four sides are not of equal length ($\frac{1}{8}$ wavelength), the difference between the length of the sides containing the split reactance and the other two sides may be compensated by making the smaller reactance a value to achieve a phase shift equal to half the electrical distance across the other two sides, and making the longer reactance a value equal to 90° minus the phase shift achieved through the smaller reactance. It is therefore intended that the claims be interpreted to cover such modifications and variations.

What is claimed is:

1. A square-loop directive antenna of half wavelength circumference driven at the center of one side and including capacitive reactances in the adjacent sides for a phase shift in the antenna voltage with respect to antenna current of 90° across each of said adjacent sides, wherein said capacitive reactance on each side is divided into two parts, one part situation next to said driven side of the loop and the other part situated next to the side of the loop opposite said driven side, and wherein said one part of capacitive reactance in each side provides a phase shift equal to about 22.5°, and the other part a phase shift equal to about 67.5°.

2. A square-loop directive antenna of half wavelength circumference driven at the center of one side and including reactances in the adjacent sides for a phase shift in the voltage with respect to antenna current of 90°, said reactances on each side being divided into two parts, one part sufficient to provide a phase shift equal to about 22.5° situated next to said driven side of the loop and the other part situated next to the side of the loop opposite said driven side.

3. A square-loop directive antenna as defined in claim 2 wherein each of said capacitive reactances is comprised of a conductive tube and an inner insulated conductor.

4. A square-loop directive antenna as defined in claim 3 wherein said conductive tubes forms at least a part of the side of said loop antenna that includes the reactance, and said inner insulated conductor is formed from a conductor of an adjoining side by bending the conductor of a length just sufficient to be inserted into the conductive tube to an extent necessary to provide the required capacitive reactance, and insulating the bent conductor at least over the extent to be inserted into said tube to provide a coaxial capacitor.

* * * * *